US011181304B2

(12) United States Patent
Yamano et al.

(10) Patent No.: US 11,181,304 B2
(45) Date of Patent: Nov. 23, 2021

(54) CHILLING UNIT AND TEMPERATURE CONTROL SYSTEM USING WATER CIRCULATION

(71) Applicant: Mitsubishi Electric Corporation, Tokyo (JP)

(72) Inventors: Yoshio Yamano, Tokyo (JP); Kimitaka Kadowaki, Tokyo (JP); Takahiro Akizuki, Tokyo (JP); Takuya Ito, Tokyo (JP); Yasushi Okoshi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 120 days.

(21) Appl. No.: 16/487,891

(22) PCT Filed: May 19, 2017

(86) PCT No.: PCT/JP2017/018815
§ 371 (c)(1),
(2) Date: Aug. 22, 2019

(87) PCT Pub. No.: WO2018/211682
PCT Pub. Date: Nov. 22, 2018

(65) Prior Publication Data

US 2020/0064031 A1 Feb. 27, 2020

(51) Int. Cl.
*F25B 13/00* (2006.01)
*F25B 6/00* (2006.01)
*F25B 49/02* (2006.01)

(52) U.S. Cl.
CPC ..... *F25B 13/00* (2013.01); *F25B 6/00* (2013.01); *F25B 49/02* (2013.01)

(58) Field of Classification Search
CPC .. F25B 13/00; F25B 6/00; F25B 49/02; F25B 41/40; F25B 41/20; F25B 25/005;
(Continued)

(56) References Cited

U.S. PATENT DOCUMENTS 10,415,861 B2 * 9/2019 Takenaka ..... F25B 47/02
2013/0213067 A1 * 8/2013 Wajima ..... F25B 49/02 62/126

FOREIGN PATENT DOCUMENTS

EP 3228951 A1 10/2017
EP 3367010 A1 8/2018
(Continued)

OTHER PUBLICATIONS

Ito et al., Refrigeration Cycle Apparatus, Jun. 9, 2016, WO2016088262A1, Whole Document (Year: 2016).*
(Continued)

*Primary Examiner* — Larry L Furdge
(74) *Attorney, Agent, or Firm* — Posz Law Group, PLC

(57) ABSTRACT

A chilling unit and a water circulation temperature control system includes a refrigerant circuit, a pipe through which a heat medium flows, a flow switching valve, a temperature sensor, a pressure sensor, and a controller. The refrigerant circuit includes a compressor, a pair of air-side heat exchangers, an expansion valve, and a heat-medium-side heat exchanger connected to each other by pipes. The flow switching valve switches between refrigerant-circulation routes. The controller controls the compressor in accordance with a target outlet temperature, the heat medium temperature detected by the temperature sensor, and a heat medium pressure difference detected by the pressure sensor. When a load on an air handler decreases to a low level and is equal to or less than the compressor's lowest capacity, the controller controls the flow switching valve so that one of the air-side heat exchangers and the heat-medium-side heat exchanger are connected in parallel.

5 Claims, 6 Drawing Sheets

(58) Field of Classification Search
CPC ..... F25B 2313/0253; F25B 2313/2313; F25B 2313/0254; F25B 2313/003; F25B 2313/0314; F25B 2400/06; F25B 2313/02732; F25B 2313/02741; F25B 2600/2507; F25B 1/00; F25B 29/00
See application file for complete search history.

(56) References Cited

FOREIGN PATENT DOCUMENTS

| | | | |
|---|---|---|---|
| JP | S63-007314 | B2 | 2/1988 |
| JP | H07-1 20089 | A | 5/1995 |
| JP | 2014-159923 | A | 9/2014 |
| JP | 2016-053429 | A | 4/2016 |
| WO | 2016/088262 | A1 | 6/2016 |
| WO | WO2016088262 | A1 * | 6/2016 |
| WO | 2017/068631 | A1 | 4/2019 |

OTHER PUBLICATIONS

International Search Report of the International Searching Authority dated Aug. 15, 2017 for the corresponding International application No. PCT/JP2017/018815 (and English translation).

* cited by examiner

CHILLING UNIT AND TEMPERATURE CONTROL SYSTEM USING WATER CIRCULATION

CROSS REFERENCE TO RELATED APPLICATION

This application is a U.S. national stage application of PCT/JP2017/018815 filed on May 19, 2017, the contents of which are incorporated herein by reference.

TECHNICAL FIELD

The present invention relates to a chilling unit having a refrigeration cycle and a temperature control system using water circulation and, in particular, to a chilling unit and a temperature control system using water circulation that have a configuration in which the temperature of supply water can be stabilized even under low-load conditions.

BACKGROUND ART

Up to date, chilling units have been used as, for example, the heat sources of temperature control systems using water circulation. A temperature control system using water circulation circulates water in a building or a large-scale commercial facility and uses the heat of the circulating water for heating and cooling via, for example, a fan-coil unit or an air-handling unit serving as a loading device. Temperature control systems using water circulation are also used for commercial purposes. For instance, by circulating water in a factory, the facility is cooled or the temperature of the facility is controlled. In a temperature control system using water circulation, typically, plural chilling units each having a refrigerant circuit are used per water-circulation circuit. The water pipe of each of the chilling units is connected to a loading device via a header pipe, and a water-circulation pump circulates water in the water-circulation circuit.

A chilling unit is disclosed in Patent Literature 1. Patent Literature 1 discloses a system in which the water circuit of a water heat exchanger is provided for each of four refrigerant circuits, and a pair of water circuits connected in parallel and another pair of water circuits connected in parallel are connected in series. In addition, Patent Literature 1 discloses a technique of changing the combination of water pipes through which water flows according to the operation status of each of the refrigerant circuits.

Normally, use of an inverter-controlled compressor and an inverter-controlled water-circulation pump is an effective way to stabilize the temperature of supply water in a chilling system and a temperature control system using water circulation. To enable inverters to control the compressor and the water-circulation pump, the temperature and the pressure of water near each inlet and outlet of a water heat exchanger are detected, which enables optimal control for a given load. A temperature control system using water circulation that has plural chilling units can deal with a low load by controlling the number of chilling units in operation as well as by performing control using the inverters.

CITATION LIST

Patent Literature

Patent Literature 1: WO2016/088262

SUMMARY OF INVENTION

Technical Problem

However, when an amount of heat on the load side decreases and reaches or falls below the lowest capacity of a compressor, an existing chilling unit as described above starts and stops the compressor to adjust the amount of heat so as to be proportional to a load. Thus, in some cases, a chilling unit frequently starts and stops around a target temperature of water, resulting in an unstable temperature of the supply water. Frequent starts and stops of a compressor decrease low pressure inside a refrigerant circuit and may thus cause a chilling unit operating in cooling mode to stop abnormally to avoid water inside a water heat exchanger freezing. In addition, frequent starts and stops may shorten the lifespan of a compressor.

The present invention has been made to address the above problems, and an objective thereof is to provide a chilling unit and a temperature control system using water circulation, which are capable of providing a stable temperature of supply water even under low-load conditions.

Solution to Problem

A chilling unit according to one embodiment of the present invention includes: a refrigerant circuit including a compressor, a pair of air-side heat exchangers, an expansion valve, and a heat-medium-side heat exchanger that are connected to each other by pipes, thereby enabling refrigerant to circulate in the refrigerant circuit; a pipe that is connected to a loading device and through which a heat medium flows, the heat medium being used in heat exchange with the refrigerant performed in the heat-medium-side heat exchanger; a flow switching device that switches between circulation routes of the refrigerant when control to avoid starts and stops is performed, the control being performed when the value of a load on the loading device is equal to or less than a preset value; a temperature sensor that detects the temperature of the heat medium near each of the inlet and the outlet of the heat-medium-side heat exchanger; a pressure sensor that detects a pressure difference between the pressure of the heat medium near the inlet of the heat-medium-side heat exchanger and the pressure of the heat medium near the outlet of the heat-medium-side heat exchanger; and a controller configured to control the compressor, the expansion valve, and the flow switching device. The controller controls the compressor in accordance with a target outlet temperature, the temperatures of the heat medium detected by the temperature sensor, and the pressure difference in the heat medium detected by the pressure sensor. When a load on the loading device decreases to a low level and the load is equal to or less than the lowest capacity of the compressor, the controller performs control to avoid starts and stops while keeping the compressor operating at the lowest capacity and controls the flow switching device so that one of the pair of air-side heat exchangers and the heat-medium-side heat exchanger are connected in parallel.

A chilling unit according to another embodiment of the present invention includes: two refrigerant circuits each including a compressor, a flow switching device, an air-side heat exchanger, an expansion valve, and a heat-medium-side heat exchanger that are connected to each other by pipes, thereby enabling refrigerant to circulate in the respective refrigerant circuit; a pipe that is connected to a loading device and through which a heat medium flows, the heat medium being used in heat exchange with the refrigerant performed in each of the heat-medium-side heat exchangers in the two refrigerant circuits; temperature sensors, each of which detects the temperature of the heat medium near each of the inlet and the outlet of the respective heat-medium-side heat exchanger in the two refrigerant circuits; pressure sensors, each of which detects a pressure difference between the pressure of the heat medium near the inlet and the pressure of the heat medium near the outlet, the inlet and the outlet being the inlet and the outlet of the respective heat-medium-side heat exchanger in the two refrigerant circuits; a controller that controls the compressors, the flow switching devices, and the expansion valves in the two refrigerant circuits. Each of the flow switching devices in the two refrigerant circuits switches between a circulation route for use in heating mode in which the heat-medium-side heat exchanger serves as a condenser and a circulation route for use in cooling mode in which the heat-medium-side heat exchanger serves as an evaporator. The controller controls the compressors in accordance with a target outlet temperature, the temperatures of the heat medium detected by each of the temperature sensors, and the pressure difference in the heat medium detected by each of the pressure sensors. When a load on the loading device decreases to a low level and the load is turned to be equal to or less than the lowest capacity of the compressors, the controller causes the flow switching device of one of the two refrigerant circuits to switch between the circulation routes while keeping the compressors operating at their lowest capacity.

Advantageous Effects of Invention

In the chilling unit and the temperature control system using water circulation according to an embodiment of the present invention, when a load on the loading device decreases to a low level, the flow switching device switches between refrigerant-circulation routes. Thus, it is possible for a part of the air-side heat exchangers of the chilling unit to consume an excessive portion of a heating capacity or a cooling capacity while keeping the compressor operating at the lowest capacity. As a result, even when the loading device is under low-load conditions, the chilling unit and the temperature control system using water circulation can suppress starts and stops of the compressor caused by control of a thermostat and supply a heat medium of a stable temperature to the loading device.

DESCRIPTION OF EMBODIMENTS

Embodiment 1

Figure 1:
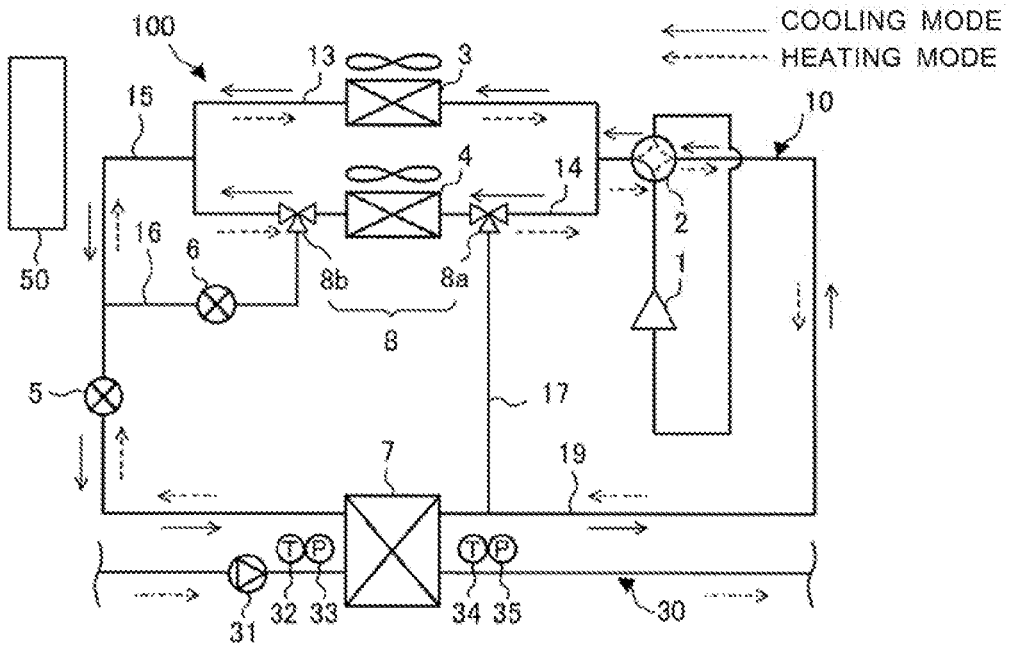
FIG. 1 schematically illustrates a configuration of a chilling unit according to Embodiment 1 of the present invention.
Figure 2:
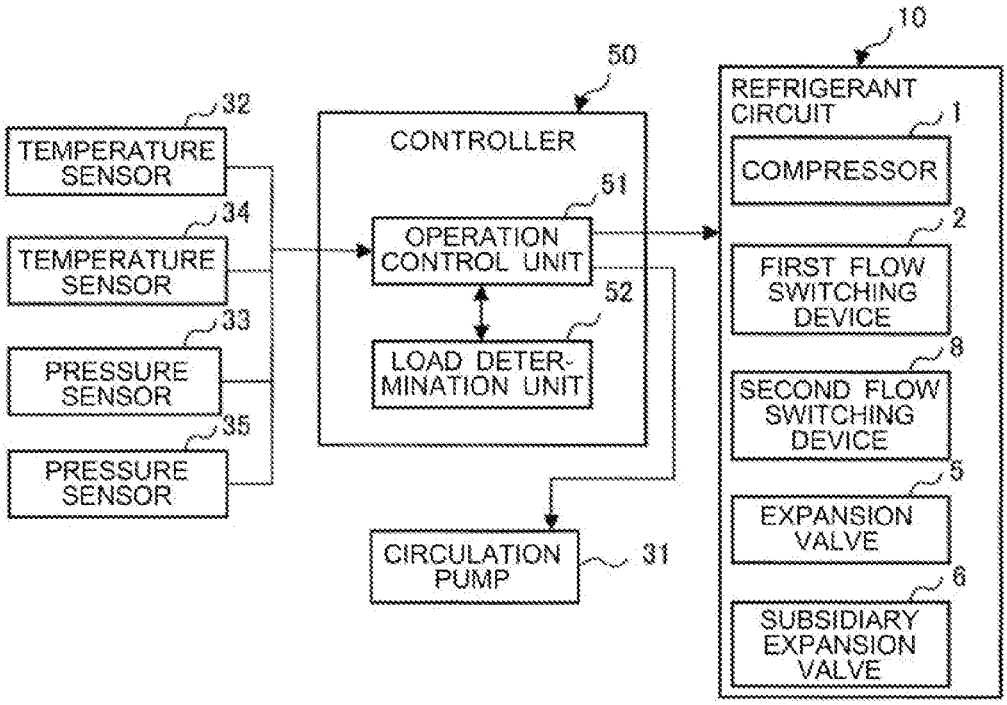
FIG. 2 is a functional block diagram of the controller of the chilling unit according to Embodiment 1 of the present invention.

With reference to FIGS. 1 and 2, a configuration of a chilling unit will be described. FIG. 1 schematically illustrates a configuration of the chilling unit according to Embodiment 1 of the present invention. FIG. 2 is a functional block diagram of the controller of the chilling unit according to Embodiment 1 of the present invention.

A chilling unit 100 heats or cools a heat medium flowing through the pipes of a heat medium circuit 30 by using refrigerant flowing through the refrigerant pipes of a refrigerant circuit 10. The heat medium heated or cooled in the chilling unit 100 is transferred to a loading device via the heat medium circuit 30, and the heat of the heat medium is used in, for example, air conditioning. Any refrigerants and heat mediums may be used. As a refrigerant, CFCs may be used, for example, and as a heat medium, water or brine may be used, for example.

(Configuration of Chilling Unit 100)

In Embodiment 1, the chilling unit 100 includes the refrigerant circuit 10 in which refrigerant circulates and a pipe of the heat medium circuit 30 in which a heat medium flows. The refrigerant circuit 10 includes a compressor 1, a first flow switching device 2, a pair of air-side heat exchangers, a second flow switching device 8, a pressure reducing device, and a heat-medium-side heat exchanger 7, which are connected to each other via the refrigerant pipes. The chilling unit 100 includes a portion of the heat medium circuit 30, and the portion of the heat medium circuit 30 includes a circulation pump 31, the heat-medium-side heat exchanger 7, and the pipe that connects the circulation pump 31 and the heat-medium-side heat exchanger 7 to each other.

The compressor 1 suctions low-temperature, low-pressure refrigerant, compresses the refrigerant into high-temperature, high-pressure refrigerant, and discharges the refrigerant, thereby circulating the refrigerant. The compressor 1 is an inverter compressor whose capacity is controllable. The first flow switching device 2 is, for example, a four-way valve and changes the direction in which refrigerant flows according to whether the chilling unit 100 will operate in cooling mode or heating mode. The first flow switching device 2 is provided on the discharge side of the compressor 1 and changes the destination to which the high-temperature, high-pressure refrigerant discharged from the compressor 1 is transferred, the destination being the pair of air-side heat exchangers or the heat-medium-side heat exchanger 7.

The pressure reducing device, which includes, for example, an electronic expansion valve, reduces the pressure of refrigerant, thereby expanding the refrigerant. The pressure reducing device is made up of an expansion valve 5 and a subsidiary expansion valve 6. The expansion valve 5 is provided in a refrigerant pipe 15 between the heat-medium-side heat exchanger 7 and a first air-side heat exchanger 3 and a second air-side heat exchanger 4. The subsidiary expansion valve 6 is provided in a first bypass pipe 16, which is described later.

The pair of air-side heat exchangers, which are made up of the first air-side heat exchanger 3 and the second air-side heat exchanger 4 connected in parallel, transfer heat between refrigerant and the air and absorb the heat of the atmosphere or release the heat of the refrigerant into the atmosphere. Under normal control, the first air-side heat exchanger 3 and the second air-side heat exchanger 4 serve as evaporators in heating mode and as condensers in cooling mode. In addition, each of the first air-side heat exchanger 3 and the second air-side heat exchanger 4 is equipped with a fan such as a propeller fan, and the fan supplies air.

In FIG. 1, the first air-side heat exchanger 3 and the second air-side heat exchanger 4 are connected in parallel. Hereinafter, a refrigerant pipe having the first air-side heat exchanger 3 is referred to as a refrigerant pipe 13, and a refrigerant pipe having the second air-side heat exchanger 4 is referred to as a refrigerant pipe 14.

The heat-medium-side heat exchanger 7 transfers heat between refrigerant and a heat medium, and heats or cools the heat medium to a target temperature by using the heat of the refrigerant. In heating mode, the heat-medium-side heat exchanger 7 exchanges heat between high-temperature, high-pressure refrigerant and the heat medium to increase the temperature of the heat medium. In cooling mode, the heat-medium-side heat exchanger 7 transfers heat between low-temperature, low-pressure refrigerant and the heat medium to decrease the temperature of the heat medium.

The second flow switching device 8 switches refrigerant-circulation routes by normal control or control to avoid starts and stops, which is described later. The second flow switching device 8 is made up of, for example, a three-way valve 8*a* and a three-way valve 8*b*. The three-way valve 8*a* and the three-way valve 8*b* are provided in the refrigerant pipe 14, interposing the second air-side heat exchanger 4 therebetween. The three-way valve 8*a* and the three-way valve 8*b* change the direction in which refrigerant flows in the second air-side heat exchanger 4. The three-way valve 8*a* is provided between the first flow switching device 2 and the second air-side heat exchanger 4, and the three-way valve 8*b* is provided between the second air-side heat exchanger 4 and the expansion valve 5.

The refrigerant circuit 10 includes a bypass bypassing the heat-medium-side heat exchanger 7. The bypass includes the first bypass pipe 16, a second bypass pipe 17, and a portion of the refrigerant pipe 14 between the three-way valve 8*a* and the three-way valve 8*b*. The first bypass pipe 16 connects the three-way valve 8*b* and a refrigerant pipe to each other, the refrigerant pipe being provided between the expansion valve 5 and the pair of the first air-side heat exchanger 3 and the second air-side heat exchanger 4. The second bypass pipe 17 connects the three-way valve 8*a* and a refrigerant pipe 19 to each other, the refrigerant pipe 19 being provided between the heat-medium-side heat exchanger 7 and the first flow switching device 2. In the refrigerant circuit 10, when the circulation route connected by the second flow switching device 8 changes, a portion or all of the refrigerant flowing toward the heat-medium-side heat exchanger 7 in the main refrigerant circuit flows into the bypass. Thus, the refrigerant-circulation route can be switched by normal control or control to avoid starts and stops.

When a load on the loading device connected to the heat medium circuit 30 decreases to a low level, control to avoid starts and stops is performed to avoid an unstable state in which the compressor 1 of the refrigerant circuit 10 repeatedly starts and stops. When the circulation route connected by the second flow switching device 8 is the circulation route for use in normal control, the direction in which refrigerant flows in the second air-side heat exchanger 4 in the bypass is identical to the direction in which refrigerant flows in the first air-side heat exchanger 3. Meanwhile, when the circulation route connected by the second flow switching device 8 is the circulation route for use in control to avoid starts and stops, the direction in which refrigerant flows in the second air-side heat exchanger 4 is identical to the direction in which refrigerant flows in the heat-medium-side heat exchanger 7.

The circulation pump 31 circulates a heat medium in the heat medium circuit 30, which enables the heat medium to flow between the loading device and the heat-medium-side heat exchanger 7, which are connected to each other via pipes so as to form a loop. The circulation pump 31 is an inverter pump and is capable of gradually or continuously changing the flow rate of the heat medium. The circulation pump 31 receives a control signal for rendering the flow rate of the heat medium proportional to the load from the controller 50, which is described later, and controls the flow rate of the circulating heat medium by driving a motor at a frequency based on the control signal.

In addition, the chilling unit 100 includes plural sensors such as a temperature sensor and a pressure sensor. In the heat medium circuit 30, the pipes near the inlet and outlet of the heat-medium-side heat exchanger 7 have a temperature sensor 32, a temperature sensor 34, a pressure sensor 33, and a pressure sensor 35. The temperature sensor 32 and the temperature sensor 34 detect the temperatures of a heat medium near the inlet and the outlet of the heat-medium-side heat exchanger 7. The pressure sensor 33 and the pressure sensor 35 detect a pressure difference between the pressure of the heat medium near the inlet of the heat-medium-side heat exchanger 7 and the pressure of the heat medium near the outlet. Although not illustrated in FIG. 1, in the refrigerant circuit 10, the inlet pipe of the compressor 1 has a low-pressure sensor for detecting the inlet pressure of refrigerant, and the outlet pipe of the compressor 1 has a high-pressure sensor for detecting the outlet pressure of refrigerant.

The controller 50 is, for example, a microcontroller and controls the actuators of the chilling unit 100. The controller 50 receives refrigerant pressure information, refrigerant temperature information, heat medium pressure information, and heat medium temperature information from the sensors. The controller 50 performs operation control in accordance with, for example, the pieces of information received from the sensors, preset information, and a command input by a user. Specifically, the controller 50 controls operation, a stop, and the rotation speed of the compressor 1, the opening degree of the reducing device, switching performed by each of the first flow switching device 2 and the second flow switching device 8, and the rotation speed of each of the fan for the first air-side heat exchanger 3 and the fan for the second air-side heat exchanger 4. The controller 50 controls the frequency of the circulation pump 31 to control the flow rate of a heat medium supplied to the heat-medium-side heat exchanger 7.

Next, with reference to FIG. 2, a functional configuration of the controller 50 is described. The controller 50 includes an operation control unit 51 and a load determination unit 52. To bring the outlet temperature of a heat medium to a target outlet temperature, the operation control unit 51 obtains optimal operation conditions by performing calculations using the target outlet temperature of the heat medium, the current temperature of the heat medium near each inlet and outlet of the heat-medium-side heat exchanger 7, and a pressure difference between the pressure of the heat medium near the inlet and the pressure of the heat medium near the outlet. The operation control unit 51 then outputs operation instructions to the actuators. The operation control unit 51 switches between heating mode and cooling mode by causing the first flow switching device 2, to change the direction in which refrigerant flows. When performing control to avoid starts and stops, the operation control unit 51 causes the second flow switching device 8 to change the direction in which refrigerant flows. In addition, the operation control unit 51 obtains the result of determination by the load determination unit 52 and performs control in accordance with the obtained result.

The load determination unit 52 receives information about the current load on the loading device from the operation control unit 51 and determines the amount of load. Specifically, the load determination unit 52 determines whether the load is decreased, whether the load is equal to or less than the lowest capacity of the compressor 1, or whether no load is applied. The load determination unit 52 then notifies the operation control unit 51 of the result of the determination. It should be noted that the operation control unit 51 may obtain the value of the current load on the loading device by performing calculations using information received from the loading device, setting information, or information about control on each actuator and information about each sensor.

Operation of the chilling unit 100 under normal control is described below. In FIG. 1, the long-dashed-dotted-line arrows along the heat medium circuit 30 denote the flow of a heat medium, the continuous-line arrows along the refrigerant circuit 10 denote the flow of refrigerant in cooling mode under normal control, and the dashed-line arrows along the refrigerant circuit 10 denote the flow of refrigerant in heating mode under normal control.

(Normal Control)

In cooling mode, refrigerant suctioned into the compressor 1 is compressed into high-temperature, high-pressure gas refrigerant and then discharged. The gas refrigerant discharged from the compressor 1 flows through the first flow switching device 2 and is divided into two portions, one of which flows into the refrigerant pipe 13 and the other flows into the refrigerant pipe 14. Then, the portion that has flowed into the refrigerant pipe 13 flows into the first air-side heat exchanger 3, which will serve as a condenser, and the portion that has flowed into the refrigerant pipe 14 flows into the second air-side heat exchanger 4, which will serve as a condenser. The portions release heat into the ambient air and are cooled, thus turning into high-pressure, intermediate-temperature refrigerant. It should be noted that the circulation route connected by the second flow switching device 8 provided in the refrigerant pipe 14 is a circulation route for use in normal control. That is, the three-way valve 8*a* connects the first flow switching device 2 and the second air-side heat exchanger 4 to each other, and the three-way valve 8*b* connects the second air-side heat exchanger 4 and the reducing device to each other. Then, the high-pressure, intermediate-temperature refrigerant that has flowed out from the first air-side heat exchanger 3 and the high-pressure, intermediate-temperature refrigerant that has flowed out from the second air-side heat exchanger 4 merge. The expansion valve 5 of the reducing device reduces the pressure of the merged refrigerant, thereby changing the refrigerant into low-pressure, two-phase refrigerant, which then flows into the heat-medium-side heat exchanger 7 as an evaporator. It should be noted that the subsidiary expansion valve 6 is closed and thus, the refrigerant will not flow into the bypass. Then, in the heat-medium-side heat exchanger 7, the low-pressure, two-phase refrigerant absorbs heat from a heat medium flowing in the heat medium circuit 30 and is heated and evaporated, thus turning into low-pressure, low-temperature gas refrigerant. The gas refrigerant that has flowed out from the heat-medium-side heat exchanger 7 flows through the first flow switching device 2 and is suctioned into the compressor 1 again. Meanwhile, the heat medium whose temperature has decreased in the heat-medium-side heat exchanger 7 is transferred from the chilling unit 100 to the loading device.

In heating mode, refrigerant suctioned into the compressor 1 is compressed into high-temperature, high-pressure gas refrigerant and then discharged. The gas refrigerant discharged from the compressor 1 flows through the first flow switching device 2 and then flows into the heat-medium-side heat exchanger 7, which will serve as a condenser. The gas refrigerant then releases heat into a heat medium flowing in the heat medium circuit 30 and is cooled, thus turning into high-pressure, intermediate-temperature refrigerant. Then, the expansion valve 5 of the reducing device reduces the pressure of the high-pressure, intermediate-temperature refrigerant, thereby changing the refrigerant into low-pressure, two-phase refrigerant. It should be noted that the subsidiary expansion valve 6 is closed, and the circulation route connected by the second flow switching device 8 provided in the refrigerant pipe 14 is a circulation route for use in normal control. Thus, refrigerant will not flow into the bypass. The low-pressure, two-phase refrigerant is divided into two portions, one of which flows into the refrigerant pipe 13 and the other flows into the refrigerant pipe 14. The portion that has flowed into the refrigerant pipe 13 flows into the first air-side heat exchanger 3, which will serve as an evaporator, and the portion that has flowed into the refrigerant pipe 14 flows into the second air-side heat exchanger 4, which will serve as an evaporator. Then, in both the first air-side heat exchanger 3 and the second air-side heat exchanger 4, the low-pressure, two-phase refrigerant absorbs heat from the ambient air and is heated and evaporated, thus turning into low-pressure, low-temperature gas refrigerant. The low-pressure, low-temperature gas refrigerant that flowed out from the first air-side heat exchanger 3 and the low-pressure, low-temperature gas refrigerant that flowed out from the second air-side heat exchanger 4 merge. The merged refrigerant flows through the first flow switching device 2 and is suctioned into the compressor 1 again. Meanwhile, the heat medium whose temperature has increased in the heat-medium-side heat exchanger 7 is transferred from the chilling unit 100 to the loading device.

In cooling mode and in heating mode, to bring the outlet temperature of a heat medium to a target outlet temperature, the controller 50 determines, for example, the capacity of the compressor 1, the capacity of the circulation pump 31, and the opening degree of the expansion valve 5. Thus, for example, when the loading device is under high-load conditions, control is performed to increase the operation capacity of the compressor 1. Meanwhile, when the loading device is under low-load conditions, control is performed to decrease the operation capacity of the compressor 1.

Figure 3:
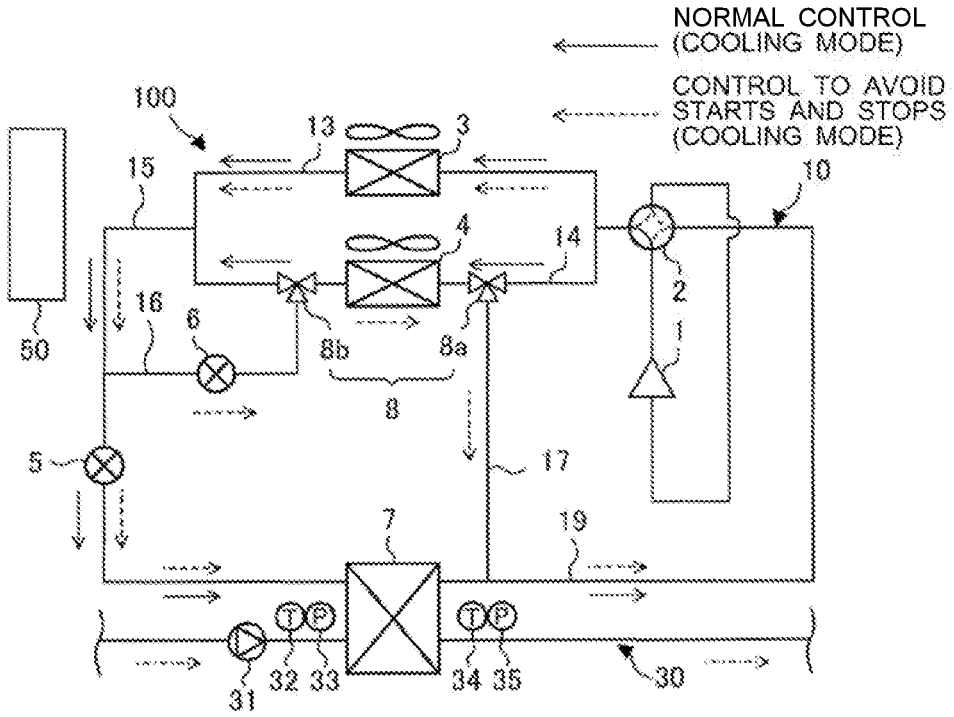
FIG. 3 is a circuit diagram illustrating the flows of refrigerant when the chilling unit according to Embodiment 1 of the present invention operates in cooling mode.

Next, with reference to FIG. 3, operation of the chilling unit 100 under control to avoid starts and stops is described. FIG. 3 is a circuit diagram illustrating the flows of refrigerant when the chilling unit according to Embodiment 1 of the present invention operates in cooling mode. In FIG. 3, the continuous-line arrows denote the flow of refrigerant in cooling mode under normal control, and the dashed-line arrows denote the flow of refrigerant in cooling mode under control to avoid starts and stops.

(Control to Avoid Starts and Stops)

During operation under normal control, when a load on the loading device decreases to a low level and the load is turned to be equal to or less than the lowest capacity of the compressor 1, control to avoid starts and stops is performed, and the circulation route connected by the second flow switching device 8 is changed. When control to avoid starts and stops is performed, the three-way valve 8*a* connects the second air-side heat exchanger 4 and the second bypass pipe 17 to each other, and the three-way valve 8*b* connects the second air-side heat exchanger 4 and the first bypass pipe 16 to each other. That is, the parallel connection of the first air-side heat exchanger 3 and the second air-side heat exchanger 4 is cancelled, and instead, the second air-side heat exchanger 4 and the heat-medium-side heat exchanger 7 are connected in parallel. As illustrated in FIG. 3, during control to avoid starts and stops, the direction in which refrigerant flows in the second air-side heat exchanger 4 is opposite to the direction in which refrigerant flows in the second air-side heat exchanger 4 during normal control. It should be noted that the subsidiary expansion valve 6 is open, and the opening degree of each of the expansion valve 5 and the subsidiary expansion valve 6 is controlled.

In cooling mode, low-temperature, low-pressure refrigerant suctioned into the compressor 1 is compressed into high-temperature, high-pressure gas refrigerant and then discharged. The gas refrigerant discharged from the compressor 1 flows through the first flow switching device 2 and then flows into the first air-side heat exchanger 3 in the refrigerant pipe 13. In the first air-side heat exchanger 3 serving as a condenser, the gas refrigerant releases heat into the ambient air and is cooled, thus turning into high-pressure, intermediate-temperature refrigerant. A portion of the high-pressure, intermediate-temperature refrigerant that has flowed out from the first air-side heat exchanger 3 flows into the expansion valve 5. The expansion valve 5 then reduces the pressure of the portion of the refrigerant, thus changing the refrigerant into low-pressure, two-phase refrigerant, which then flows into the heat-medium-side heat exchanger 7. The excessive portion of the high-pressure, intermediate-temperature refrigerant flows into the subsidiary expansion valve 6. The subsidiary expansion valve 6 reduces the pressure of the remaining refrigerant, thus changing the refrigerant into low-pressure, two-phase refrigerant, which then flows into the second air-side heat exchanger 4. For cooling mode under control to avoid starts and stops, both the heat-medium-side heat exchanger 7 and the second air-side heat exchanger 4 serve as evaporators. Then, the low-pressure, two-phase refrigerant that has flowed into the heat-medium-side heat exchanger 7 absorbs heat from a heat medium flowing in the heat medium circuit 30 and is heated and evaporated, thus turning into low-pressure, low-temperature gas refrigerant. The low-pressure, two-phase refrigerant that has flowed into the second air-side heat exchanger 4 absorbs heat from the ambient air and is heated and evaporated, thus becoming low-pressure, low-temperature gas refrigerant. The flow rate of the refrigerant flowing in the heat-medium-side heat exchanger 7 is controlled by controlling the opening degree of the expansion valve 5, and the flow rate of the refrigerant flowing in the bypass is controlled by controlling the opening degree of the subsidiary expansion valve 6. The gas refrigerant that has flowed out from the heat-medium-side heat exchanger 7 and the gas refrigerant that has flowed out from the second air-side heat exchanger 4 merge, and the merged refrigerant flows through the first flow switching device 2 and is suctioned into the compressor 1 again. Meanwhile, the heat medium whose temperature has decreased in the heat-medium-side heat exchanger 7 is transferred from the chilling unit 100 to the loading device.

By performing control to avoid starts and stops in this manner, it is possible to control the flow rate of the refrigerant flowing in the heat-medium-side heat exchanger 7. Thus, even when the operation capacity of the compressor 1 is the lowest capacity, the chilling unit 100 can perform control to further decrease an amount of heat exchanged between refrigerant and a heat medium. Accordingly, the chilling unit 100 can deal with a low load.

Figure 4:
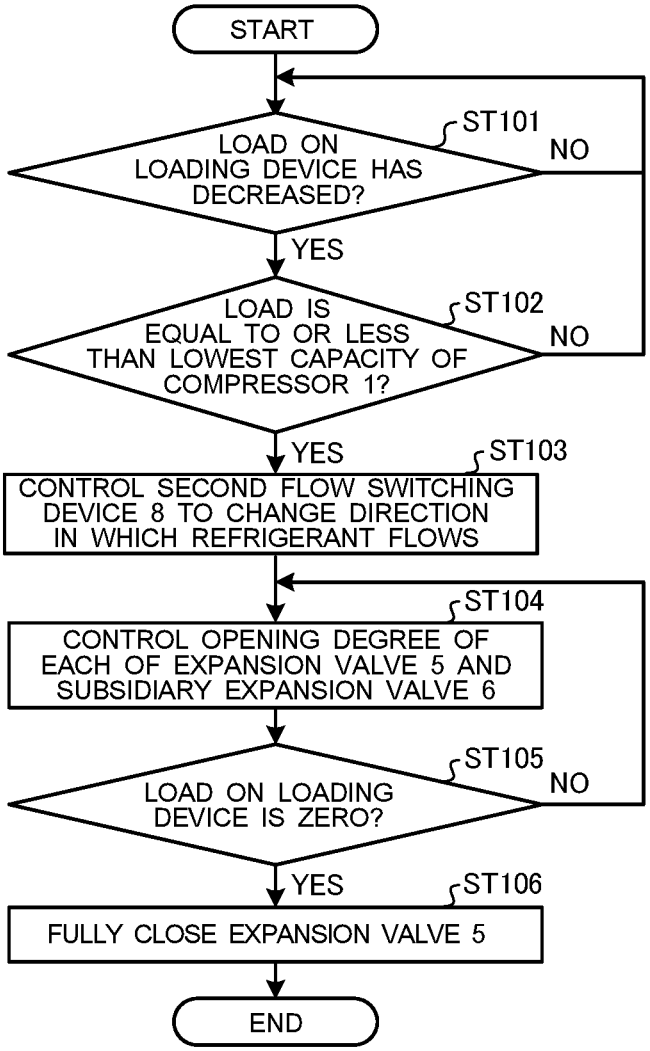
FIG. 4 is a flowchart illustrating control performed by the controller of the chilling unit according to Embodiment 1 of the present invention when a loading device is under low-load conditions.

FIG. 4 is a flowchart illustrating control performed by the controller of the chilling unit according to Embodiment 1 of the present invention when the loading device is under low-load conditions.

During operation of the chilling unit, the operation control unit 51 calculates the load on the loading device and controls the actuators in accordance with the load. The load determination unit 52 receives load information from the operation control unit 51 and determines whether the load on the loading device has decreased (step ST101). It should be noted that the load determination unit 52 may perform step ST101 by comparing currently obtained load information and previously obtained load information or by comparing the current average load over a predetermined period and the previous average load over the predetermined period. If the load has decreased (YES in step ST101), the load determination unit 52 further determines whether the loading device is under low-load conditions and the load is equal to or less than the lowest capacity of the compressor 1 (step ST102). When determining that the loading device is under low-load conditions (YES in step ST102), the load determination unit 52 notifies the operation control unit 51 of the result of the determination. The operation control unit 51 then performs control to avoid starts and stops. Meanwhile, if it is determined in step ST101 that the load has not decreased (NO in step ST101), or if it is determined in step ST102 that the load is not low (NO in step ST102), the load determination unit 52 notifies the operation control unit 51 of the result of the determination. The operation control unit 51 then continues to perform normal control. During operation, the load determination unit 52 receives information on the loading device from the operation control unit 51 and repeatedly performs step ST101 and step ST102 to monitor a decreased amount of load.

Under control to avoid starts and stops, to consume an excessive portion of a heating capacity or a cooling capacity while keeping the compressor 1 operating at the lowest capacity, the operation control unit 51 changes the circulation route connected by the second flow switching device 8 from the circulation route for use in normal control to the circulation route for use in control to avoid starts and stops (step ST103). For example, when performing control to avoid starts and stops in cooling mode, the first air-side heat exchanger 3 serves as a condenser, and the second air-side heat exchanger 4 serves as an evaporator. Each of the first air-side heat exchanger 3 and the second air-side heat exchanger 4 transfers heat between refrigerant and the atmosphere. The operation control unit 51 controls the opening degree of each of the expansion valve 5 and the subsidiary expansion valve 6 so that an amount of heat exchanged in the heat-medium-side heat exchanger 7 is proportional to the load on the loading device (step ST104). If the load on the loading device is low, it suffices that the operation control unit 51 perform control to decrease the opening degree of the expansion valve 5, thereby decreasing the flow rate of the refrigerant flowing in the heat-medium-side heat exchanger 7.

Then, the load determination unit 52 determines whether the loading device is under zero-load or no-load conditions (step ST105). If the load on the loading device is not zero (NO in step ST105), the operation control unit 51 repeatedly controls the opening degree of each of the expansion valve 5 and the subsidiary expansion valve 6 (step ST104). Meanwhile, if the load on the loading device is zero (YES in step ST105), the operation control unit 51 fully closes the expansion valve 5 (step ST106). When the expansion valve 5 is fully closed, all the refrigerant flowing toward the heat-medium-side heat exchanger 7 flows into the bypass, and the second air-side heat exchanger 4 transfers heat between the refrigerant and the atmosphere.

Thus, even under no-load conditions, an excessive portion of the heating capacity or the cooling capacity is cancelled out by each of the first air-side heat exchanger 3 and the second air-side heat exchanger 4 transferring heat between the refrigerant and the atmosphere. It should be noted that if the heat medium circuit 30 is under no-load conditions, to cancel out an excessive portion of the capacity in the refrigerant circuit 10, it is desirable that the first air-side heat exchanger 3 and the second air-side heat exchanger 4 be able to operate at equivalent heat-exchange capacities.

In cooling mode, when the loading device is under low-load conditions, the opening degree of the expansion valve 5 should be controlled so as to maintain the temperature of refrigerant at which the heat-medium-side heat exchanger 7 does not freeze (e.g., temperature equal to or higher than zero degrees Celsius). By controlling the expansion valve 5 in this manner, the chilling unit 100 can render the flow rate of a heat medium very low in the heat medium circuit 30 in accordance with the pressure difference between pressure detected by the pressure sensor 33 and pressure detected by the pressure sensor 35, which enables reduction of the power of the circulation pump 31.

It should be noted that, although the case in which the first air-side heat exchanger 3 and the second air-side heat exchanger 4 are connected in parallel is described above as an example, the connection is not limited to the parallel connection. Any circuitry is applicable as long as the second air-side heat exchanger 4 can function as described above under normal control and under control to avoid starts and stops, and it is possible to control the flow rate of refrigerant flowing in the heat-medium-side heat exchanger 7 during control to avoid starts and stops.

As described above, in Embodiment 1, the chilling unit 100 includes the refrigerant circuit 10, the pipe through which a heat medium flows, the flow switching device (second flow switching device 8), and the controller 50. The refrigerant circuit 10 includes the compressor 1, the pair of air-side heat exchangers (e.g., first air-side heat exchanger 3 and second air-side heat exchanger 4), the expansion valve 5, and the heat-medium-side heat exchanger 7. When a load on the loading device decreases to a low level, while keeping the compressor 1 operating at the lowest capacity, the controller 50 causes the flow switching device (second flow switching device 8) to change the direction in which refrigerant flows and allows one of the pair of air-side heat exchangers (second air-side heat exchanger 4) and the heat-medium-side heat exchanger 7 to be connected in parallel.

Thus, when the load on the loading device decreases to a low level, the chilling unit 100 can consume an excessive portion of the heating capacity or the cooling capacity in the second air-side heat exchanger 4 while keeping the compressor 1 operating at the lowest capacity. Accordingly, even under low-load conditions, the chilling unit 100 can suppress starts and stops of the compressor 1 caused by control of a thermostat and supply a heat medium of a stable temperature to the loading device.

One of the pair of air-side heat exchangers (second air-side heat exchanger 4) and the other (first air-side heat exchanger 3) are connected in parallel. However, in order to perform control to avoid starts and stops, when the flow switching device (second flow switching device 8) changes the direction in which refrigerant flows, the parallel connection of one of the pair of air-side heat exchangers and the other is cancelled.

Thus, according to switching performed by the second flow switching device 8 for switching between the refrigerant-circulation routes, the second air-side heat exchanger 4 can assist the first air-side heat exchanger 3 under normal control and the heat-medium-side heat exchanger 7 under control to avoid starts and stops, which enables consumption of an excessive portion of the heating capacity or the cooling capacity.

The expansion valve 5 is provided in the refrigerant pipe 15 between the heat-medium-side heat exchanger 7 and the pair of air-side heat exchangers (first air-side heat exchanger 3 and second air-side heat exchanger 4). When the load on the loading device is zero, the controller 50 fully closes the expansion valve 5.

Thus, when the loading device is under low-load conditions, control for the second flow switching device 8 is changed to control to avoid starts and stops while keeping the compressor 1 operating at the lowest capacity. Then, when the load is zero, the controller 50 fully closes the expansion valve 5. Thus, when the loading device is under no-load conditions, the heat-medium-side heat exchanger 7 does not transfer heat. The second air-side heat exchanger 4 exchanges heat between refrigerant and the air to cancel out a remaining portion of the heating capacity or the cooling capacity. Accordingly, even under no-load conditions, the chilling unit 100 can suppress starts and stops of the compressor 1 caused by control of the thermostat and supply a heat medium of a stable temperature to the loading device.

The chilling unit 100 further includes the inverter circulation pump 31 capable of changing the flow rate of a heat medium. In cooling mode to cool a heat medium, when the loading device is under low-load conditions, the controller 50 controls the opening degree of the expansion valve 5 so as to maintain the temperature of refrigerant at which the heat-medium-side heat exchanger 7 does not freeze.

Thus, even under low-load conditions, by controlling the compressor 1 not to start and stop repeatedly, low pressure is stabilized and thus, the temperature of refrigerant is stabilized. Accordingly, even under low-load conditions, it is possible to render the flow rate of a heat medium very low without causing, for example, an abnormal stop. By using the circulation pump 31 capable of changing the flow rate of a heat medium and the expansion valve 5 having a variable opening degree, it is possible to control the flow rate of a heat medium or the flow rate of refrigerant flowing in the heat-medium-side heat exchanger 7. Thus, even when little load is applied to the loading device, the chilling unit 100 can adjust an amount of heat so as to be proportional to the load. Accordingly, the chilling unit 100 can reduce the power of the circulation pump 31.

Embodiment 2

Figure 5:
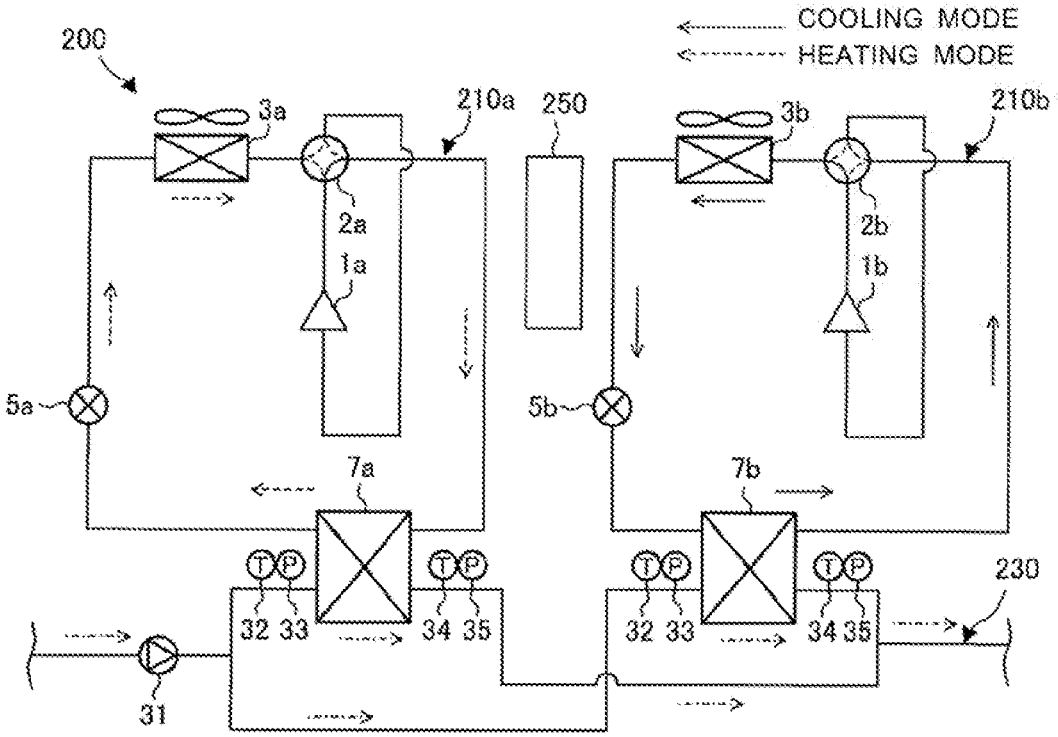
FIG. 5 schematically illustrates a configuration of a chilling unit according to Embodiment 2 of the present invention.
Figure 6:
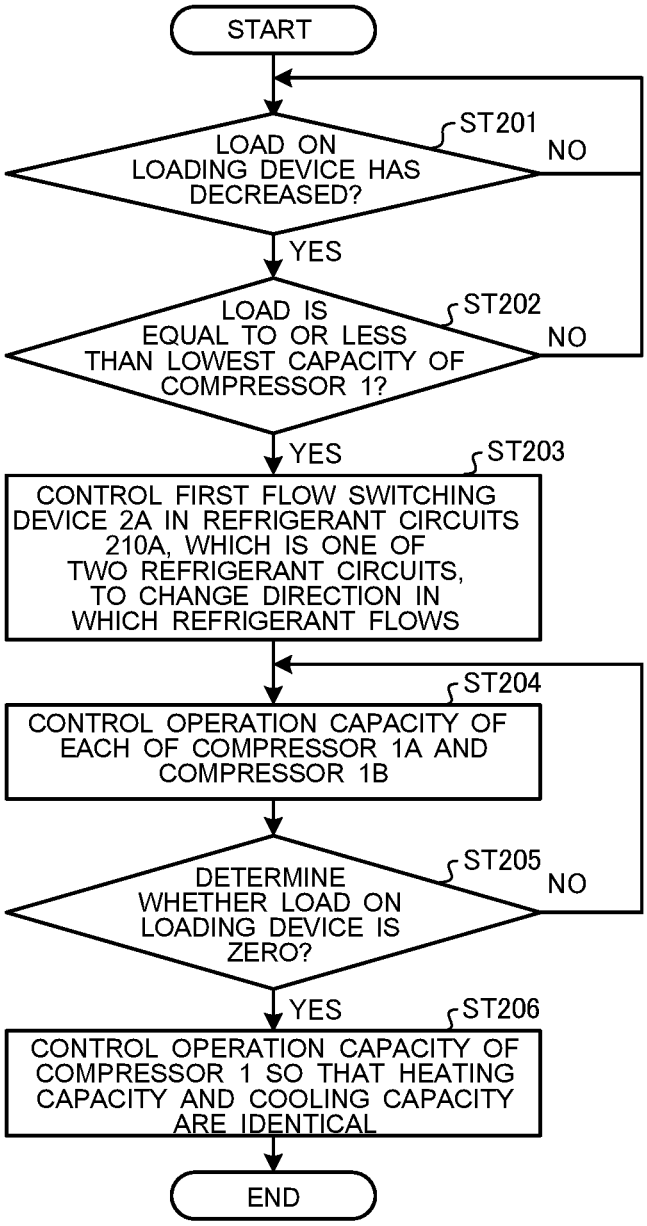
FIG. 6 is a flowchart illustrating control performed by the controller of the chilling unit according to Embodiment 2 of the present invention when a loading device is under low-load conditions.

With reference to FIGS. 5 and 6, a chilling unit 200 in Embodiment 2 is described. FIG. 5 schematically illustrates a configuration of the chilling unit according to Embodiment 2 of the present invention. FIG. 6 is a flowchart illustrating control performed by the controller of the chilling unit according to Embodiment 2 of the present invention when a loading device is under low-load conditions. Hereinafter, configuration differences between the chilling unit 200 in Embodiment 2 and the chilling unit 100 in Embodiment 1 are described, and explanations for equivalent parts are omitted.

In Embodiment 2, the chilling unit 200 includes two refrigerant circuits. A refrigerant circuit 210*a* includes a compressor 1*a*, a first flow switching device 2*a*, an air-side heat exchanger 3*a*, an expansion valve 5*a*, and a heat-medium-side heat exchanger 7*a*. Likewise, a refrigerant circuit 210*b* includes a compressor 1*b*, a first flow switching device 2*b*, an air-side heat exchanger 3*b*, an expansion valve 5*b*, and a heat-medium-side heat exchanger 7*b*. That is, the chilling unit 200 in Embodiment 2 does not include the second air-side heat exchanger 4, the second flow switching device 8, the bypass, or the subsidiary expansion valve 6 in Embodiment 1. In FIG. 5, the heat-medium-side heat exchanger 7*a* in the refrigerant circuit 210*a* and the heat-medium-side heat exchanger 7*b* in the refrigerant circuit 210*b* are connected in parallel in a heat medium circuit 230.

In Embodiment 2, in the heat medium circuit 230, a circulation pump 31 is provided on the upstream side of the heat-medium-side heat exchanger 7*a* and the heat-medium-side heat exchanger 7*b*. A temperature sensor 32, a temperature sensor 34, a pressure sensor 33, and a pressure sensor 35 are provided for the heat-medium-side heat exchanger 7*a*. Likewise, a temperature sensor 32, a temperature sensor 34, a pressure sensor 33, and a pressure sensor 35 are provided for the heat-medium-side heat exchanger 7*b*. The sensors 32 to 35 for each of the heat-medium-side heat exchanger 7*a* and the heat-medium-side heat exchanger 7*b* detect the temperatures of a heat medium near the inlet and the outlet of the heat-medium-side heat exchanger and a pressure difference between the pressure of the heat medium near the inlet and the pressure of the heat medium near the outlet. As in the case of Embodiment 1, the refrigerant circuit 210*a* includes a low-pressure sensor for detecting the inlet pressure of the compressor 1*a* and a high-pressure sensor for detecting the outlet pressure of the compressor 1*a*. Likewise, the refrigerant circuit 210*b* includes a low-pressure sensor for detecting the inlet pressure of the compressor 1*b* and a high-pressure sensor for detecting the outlet pressure of the compressor 1*b*.

Operation of the chilling unit 200 under normal control is described. In FIG. 5, the long-dashed-dotted-line arrows along the heat medium circuit 230 denote the flow of a heat medium. The dashed-line arrows along the refrigerant circuit 210*a* denote the flow of refrigerant in heating mode, and the continuous-line arrows along the refrigerant circuit 210*b* denote the flow of refrigerant in cooling mode.

(Normal Control)

In cooling mode, refrigerant suctioned into the compressor 1*b* is compressed into high-temperature, high-pressure gas refrigerant and then discharged. The gas refrigerant discharged from the compressor 1*b* flows through the first flow switching device 2*b* and then flows into the air-side heat exchanger 3*b*, which will serve as a condenser. Then, the gas refrigerant releases heat into the ambient air and turns into high-pressure, intermediate-temperature refrigerant. The high-pressure, intermediate-temperature refrigerant that has flowed out from the air-side heat exchanger 3*b* flows into the expansion valve 5*b*. The expansion valve 5*b* reduces the pressure of the high-pressure, intermediate-temperature refrigerant, thereby changing the refrigerant into low-pressure, two-phase refrigerant, which then flows into the heat-medium-side heat exchanger 7*b* as an evaporator. In the heat-medium-side heat exchanger 7*b*, the low-pressure, two-phase refrigerant absorbs heat from a heat medium flowing in the heat medium circuit 230 and is heated and evaporated, thus turning into low-pressure, low-temperature gas refrigerant. The gas refrigerant that has flowed out from the heat-medium-side heat exchanger 7*b* flows through the first flow switching device 2*b* and is then suctioned into the compressor 1*b* again. Meanwhile, the heat medium whose temperature has decreased by releasing heat in the heat-medium-side heat exchanger 7*b* is transferred from the chilling unit 200 to a loading device.

In heating mode, refrigerant suctioned into the compressor 1*a* is compressed into high-temperature, high-pressure gas refrigerant and then discharged. The gas refrigerant discharged from the compressor 1*a* flows through the first flow switching device 2*a* and then flows into the heat-medium-side heat exchanger 7*a*, which will serve as a condenser. The gas refrigerant releases heat into the heat medium flowing in the heat medium circuit 30, thus becoming high-pressure, intermediate-temperature refrigerant. The high-pressure, intermediate-temperature refrigerant that has flowed out from the heat-medium-side heat exchanger 7*a* flows into the expansion valve 5*a*. The expansion valve 5*a* reduces the pressure of the high-pressure, intermediate-temperature refrigerant, changing the refrigerant into low-pressure, two-phase refrigerant, which then flows into the air-side heat exchanger 3*a*. In the air-side heat exchanger 3*a*, the low-pressure, two-phase refrigerant absorbs heat from the ambient air and is heated and evaporated, thus becoming low-pressure, low-temperature gas refrigerant. The low-pressure, low-temperature gas refrigerant that has flowed out from the air-side heat exchanger 3*a* flows through the first flow switching device 2*a* and is then suctioned into the compressor 1*a* again. Meanwhile, the heat medium whose temperature has increased by absorbing heat in the heat-medium-side heat exchanger 7*a* is transferred from the chilling unit 200 to the loading device.

In cooling mode and in heating mode, to bring the temperature of the heat medium to a target outlet temperature, the controller 250 determines, for example, the capacity of the compressor 1, the capacity of the circulation pump 31, and the opening degree of the expansion valve 5. In Embodiment 2, since having the two refrigerant circuits, the chilling unit 200 can share a load. Thus, the chilling unit 200 can deal with a higher load, compared with the chilling unit 100 having just one refrigerant circuit.

With reference to FIG. 6, control that the controller 250 performs when the loading device is under low-load conditions is described. Here, the chilling unit 200 operates in cooling mode under normal control by using the refrigerant circuit 210*a* and the refrigerant circuit 210, and the compressor 1*a* and the compressor 1*b* operate at their lowest capacity.

During operation of the chilling unit, an operation control unit 51 calculates the load on the loading device and controls the actuators in accordance with the load. A load determination unit 52 receives load information from the operation control unit 51 and determines whether the load on the loading device has decreased (step ST201). It should be noted that the load determination unit 52 may perform step ST201 by comparing currently obtained load information and previously obtained load information or by comparing the current average load over a predetermined period and the previous average load over the predetermined period. If the load has decreased (YES in step ST201), the load determination unit 52 further determines whether the loading device is under low-load conditions and the load is equal to or less than the lowest capacity of the compressor 1*a* and the compressor 1*b* (step ST202). When determining that the loading device is under low-load conditions (YES in step ST202), the load determination unit 52 notifies the operation control unit 51 of the result of the determination. The operation control unit 51 then performs control to avoid starts and stops. Meanwhile, if it is determined in step S201 that the load has not decreased (NO in step ST201), or if it is determined in step ST202 that the load on the loading device is not low (NO in step ST202), the load determination unit 52 notifies the operation control unit 51 of the result of the determination. The operation control unit 51 then continues to perform normal control. During operation, the load determination unit 52 receives loading-device load information from the operation control unit 51 and repeatedly performs step ST201 and step ST202 to monitor a decreased amount of load.

Under control to avoid starts and stops, to consume a remaining portion of a cooling capacity while keeping the compressor 1*a* and the compressor 1*b* operating at their lowest capacity, the operation control unit 51 causes the first flow switching device 2*a* in the refrigerant circuit 210*a*, which is one of the two refrigerant circuits, to change the refrigerant-circulation route to the circulation route for use in heating mode (step ST203). The operation control unit 51 controls the operation capacity of the compressor 1*a* and the operation capacity of the compressor 1*b* so that an amount of heat exchanged in the heat-medium-side heat exchanger 7*a* and the heat-medium-side heat exchanger 7*b* is proportional to the load on the loading device (step ST204). For instance, the operation control unit 51 should control the compressor 1*a* and the compressor 1*b* so that, as the load on the loading device is decreased, a difference between the cooling capacity of the refrigerant circuit 210*b* and the heating capacity of the refrigerant circuit 210*a* is decreased. Thus, when control to avoid starts and stops is performed in cooling mode, the refrigerant circuit 210*a*, which is one of the two refrigerant circuits, heats a heat medium, and the refrigerant circuit 210*b*, which is the other refrigerant circuit, cools the heat medium. Thus, it is possible to decrease a total amount of heat exchanged between the heat medium and refrigerant, compared with when normal control.

Then, the load determination unit 52 determines whether the loading device is under zero-load or no-load conditions (step ST205). If the load on the loading device is not zero (No in step ST205), the operation control unit 51 repeatedly controls the operation capacity of the compressor 1*a* and the operation capacity of the compressor 1*b* (step ST204). If the load on the loading device is zero (YES in step ST205), the operation control unit 51 controls the operation capacity of the compressor 1*a* and the operation capacity of the compressor 1*b* (step ST206). Specifically, at least one of the compressor 1*a* and the compressor 1*b* is controlled so that the cooling capacity of the refrigerant circuit 210*b* operating in cooling mode and the heating capacity of the refrigerant circuit 210*a* operating in heating mode are identical. Thus, a total amount of heat transferred between the heat medium circuit 230 and the refrigerant circuit 210*a* and the refrigerant circuit 210*b* is cancelled out.

In cooling mode, when the loading device is under low-load conditions, the operation control unit 51 should control the opening degree of the expansion valve 5*b* so as to maintain the temperature of refrigerant at which the heat-medium-side heat exchanger 7*b* provided in the refrigerant circuit operating in cooling mode does not freeze (e.g., temperature equal to or higher than 0 degrees Celsius). By controlling the expansion valve 5*b* in this manner, the chilling unit 100 can render the flow rate of a heat medium very low in the heat medium circuit 230 in accordance with the pressure difference between pressure detected by the pressure sensor 33 and pressure detected by the pressure sensor 35, which enables reduction of the power of the circulation pump 31.

It should be noted that in Embodiment 2, the case in which the heat-medium-side heat exchanger 7*a* and the heat-medium-side heat exchanger 7*b* are connected in parallel in the heat medium circuit 230 is described above. However, the heat-medium-side heat exchanger 7*a* and the heat-medium-side heat exchanger 7*b* may be connected in series.

Figure 7:
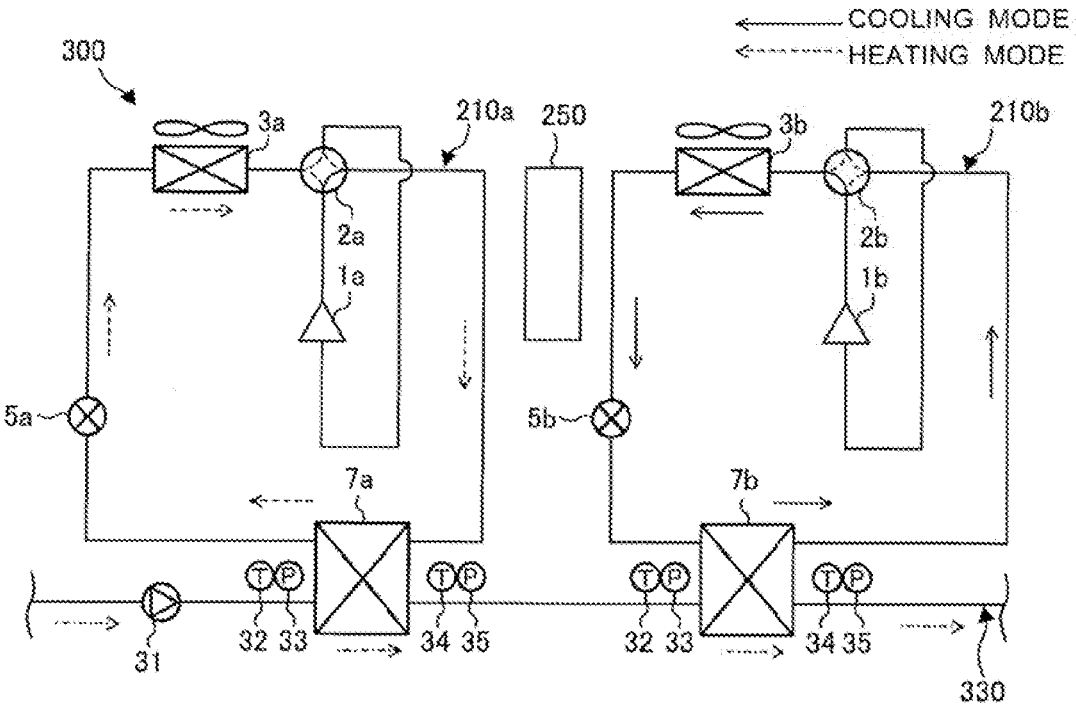
FIG. 7 schematically illustrates another configuration of the chilling unit according to Embodiment 2 of the present invention.

FIG. 7 schematically illustrates another configuration of the chilling unit according to Embodiment 2 of the present invention. In a chilling unit 300 in FIG. 7, the heat-medium-side heat exchanger 7*a* and the heat-medium-side heat exchanger 7*b* are connected in series in a heat medium circuit 330. The refrigerant circuit 210*a* includes the heat-medium-side heat exchanger on the upstream side in the direction in which a heat medium flows, and the first flow switching device 2*a* in the refrigerant circuit 210*a* is controlled to change the circulation route to the circulation route for use in heating mode, thereby heating the heat medium. The refrigerant circuit 210*b* includes the heat-medium-side heat exchanger on the downstream side in the direction in which the heat medium flows, and the refrigerant circuit 210*b* operating in cooling mode cools the heat medium.

Thus, in the heat medium circuit 330, the heat-medium-side heat exchanger 7*b* on the downstream side cools the heat medium heated in the heat-medium-side heat exchanger 7*a* on the upstream side. Thus, it is possible to avoid a significant decrease in the temperature of the heat medium, compared with when cooling the heat medium first and then heating the heat medium. Accordingly, even in the case of rendering the flow rate of a heat medium very low when the loading device is under low-load conditions, the chilling unit 300 can operate at a heating capacity or a cooling capacity proportional to the load without freezing.

As described above, in Embodiment 2, the chilling unit 200 and the chilling unit 300 each include the refrigerant circuit 210*a*, the refrigerant circuit 210*b*, pipes through which a heat medium flows, and the controller 250. In the refrigerant circuit 210*a*, the compressor 1*a*, the flow switching device (first flow switching device 2*a*), the air-side heat exchanger 3*a*, the expansion valve 5*a*, and the heat-medium-side heat exchanger 7*a* are connected to each other by pipes. In the refrigerant circuit 210*b*, the compressor 1*b*, the flow switching device (first flow switching device 2*b*), the air-side heat exchanger 3*b*, the expansion valve 5*b*, the heat-medium-side heat exchanger 7*b* are connected to each other by pipes. The flow switching devices (first flow switching device 2*a* and first flow switching device 2*b*) switch between the circulation route for use in heating mode in which the heat-medium-side heat exchanger 7*a* and the heat-medium-side heat exchanger 7*b* serve as condensers and the circulation route for use in cooling mode in which the heat-medium-side heat exchanger 7*a* and the heat-medium-side heat exchanger 7*b* serve as evaporators. When a load on the loading device decreases to a low level, the controller 250 causes the flow switching device (e.g., first flow switching device 2*a*) of one of the two refrigerant circuits (e.g., refrigerant circuit 210*a*) to switch between the circulation routes while keeping the compressor 1*a* and the compressor 1*b* operating at their lowest capacity.

Thus, when the load on the loading device decreases to a low level, while keeping the compressor 1*a* and the compressor 1*b* operating, the chilling unit 200 and the chilling unit 300 can consume a remaining portion of the heating capacity or cooling capacity of the entire chilling unit by a particular combination of operation mode of the refrigerant circuit 210*a* and operation mode of the refrigerant circuit 210*b*. Accordingly, even when the loading device is under low-load conditions, the chilling unit 200 and the chilling unit 300 can suppress starts and stops of each of the compressor 1*a* and the compressor 1*b* caused by control of a thermostat and supply a heat medium of a stable temperature to the loading device.

When the load on the loading device is zero, the controller 250 controls the operation capacity of the compressor 1*a* or the compressor 1*b* of at least one of the refrigerant circuit 210*a* and the refrigerant circuit 210*b* so that the heating capacity of the refrigerant circuit 210*a* operating in heating mode and the cooling capacity of the refrigerant circuit 210*b* operating in cooling mode are identical.

Thus, when the load decreases to a low level, the direction in which refrigerant flows is changed in one of the refrigerant circuits while keeping the compressor 1*a* and the compressor 1*b* operating. Then, when the load is zero, at least one of the operation capacity of the compressor 1*a* and the operation capacity of the compressor 1*b* is controlled so that the heating capacity and the cooling capacity are identical. Accordingly, an amount of heat exchanged in the heat-medium-side heat exchanger 7*a* and an amount of heat exchanged in the heat-medium-side heat exchanger 7*b* are cancelled out. Thus, even when the loading device is under no-load conditions, the chilling unit 200 and the chilling unit 300 can suppress starts and stops of each of the compressor 1*a* and the compressor 1*b* caused by control of the thermostat and supply a heat medium of a stable temperature to the loading device.

The chilling unit 200 and the chilling unit 300 each further include the inverter circulation pump 31 capable of changing the flow rate of a heat medium. In cooling mode to cool a heat medium, when the loading device is under low-load conditions, the controller 250 controls the opening degree of the expansion valve 5*b* of the refrigerant circuit 210*b* so as to maintain the temperature of refrigerant at which the heat-medium-side heat exchanger 7*b* in the refrigerant circuit (e.g., refrigerant circuit 210*b*) operating in cooling mode does not freeze.

Thus, even when the loading device is under low-load conditions, by performing control to avoid starts and stops of each of the compressor 1*a* and the compressor 1*b*, low pressure can be stabilized, and thus, the temperature of refrigerant is stabilized, which makes it possible to render the flow rate of the heat medium very low without causing an abnormal stop. By using the circulation pump 31 capable of changing the flow rate of a heat medium and the expansion valve 5*a* and the expansion valve 5*b* each having a variable opening degree, it is possible to control the flow rate of a heat medium or the flow rate of refrigerant flowing in each of the heat-medium-side heat exchanger 7*a* and the heat-medium-side heat exchanger 7*b*. Thus, even when little load is being applied to the loading device, the chilling unit 200 and the chilling unit 300 can adjust an amount of heat so as to be proportional to the load. Accordingly, the chilling unit 200 and the chilling unit 300 can reduce the power of the circulation pump 31.

In the heat medium circuit 330, the heat-medium-side heat exchanger 7*a* and the heat-medium-side heat exchanger 7*b* in the respective refrigerant circuits are connected in series. In cooling mode to cool a heat medium, when the loading device is under low-load conditions, the controller 250 causes the flow switching device (first flow switching device 2*a*) to change the circulation route to the circulation route for use in heating mode, the flow switching device being provided in the refrigerant circuit (e.g., refrigerant circuit 210*a*) having the heat-medium-side heat exchanger on the upstream side among the heat-medium-side heat exchanger 7*a* and the heat-medium-side heat exchanger 7*b*.

Thus, in the heat medium circuit 330, a heat medium heated in the refrigerant circuit 210*a* on the upstream side and a heat medium cooled in the refrigerant circuit 210*b* on the downstream side are mixed, thus suppressing a significant decrease in the temperature of the heat medium. Accordingly, it is possible to provide the chilling unit 300 that will not freeze even if the flow rate of the heat medium is rendered very low under low-load conditions.

It should be noted that control to avoid starts and stops described above is performed by changing operation mode of the refrigerant circuit 210*a*, which is one of the two refrigerant circuits, while keeping both the compressor 1*a* and the compressor 1*b* operating at their lowest capacity. However, any control may be performed as long as a low load can be dealt with. For example, when the value of a load falls below a preset value, the controller 250 may stop operation of the refrigerant circuit 210*a*, which is one of the two refrigerant circuits. Then, when the load reaches or falls below the lowest capacity of the compressor 1*b*, the controller 250 may perform control to cause the refrigerant circuit 210*a*, whose operation has been stopped, to operate so that the direction in which refrigerant flows in the refrigerant circuit 210*a* opposite to the direction in which refrigerant flows in the refrigerant circuit 210*b*.

Embodiment 3

Figure 8:
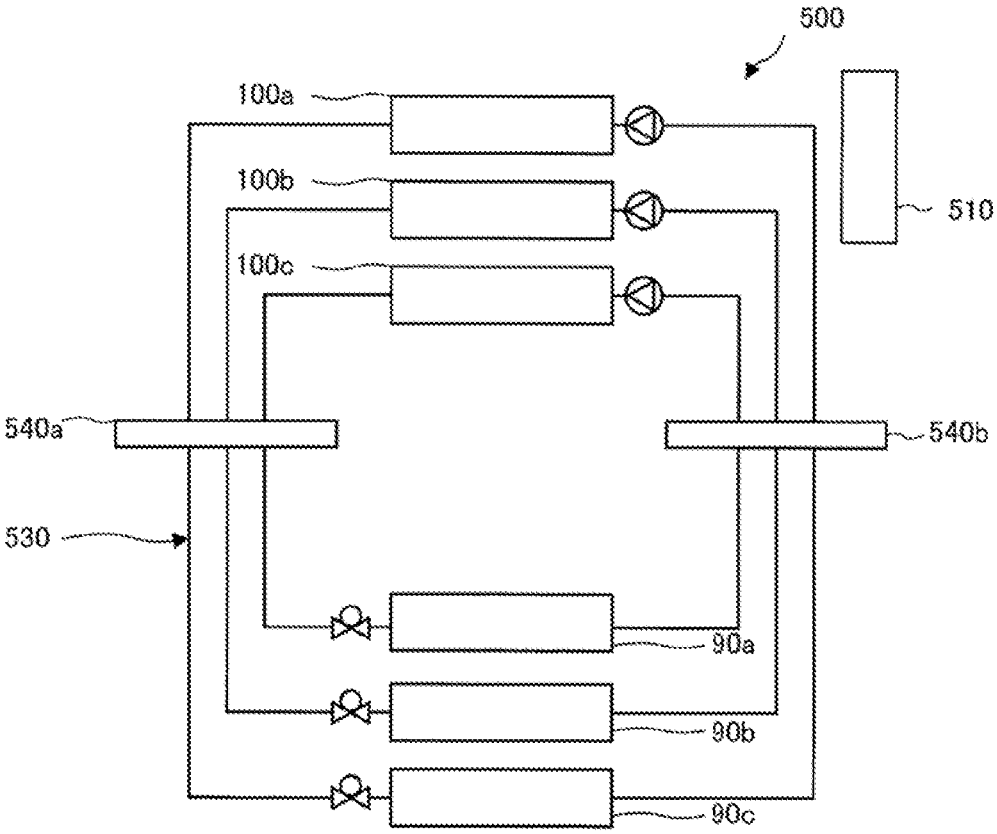
FIG. 8 schematically illustrates a configuration of a temperature control system according to Embodiment 3 of the present invention.

FIG. 8 schematically illustrates a configuration of a temperature control system according to Embodiment 3 of the present invention. As illustrated in FIG. 8, in a temperature control system using water circulation 500, the plural chilling units 100 in Embodiment 1 are provided in a water circuit 530.

The temperature control system using water circulation 500 includes a chilling unit 100*a*, a chilling unit 100*b*, a chilling unit 100*c*, a loading device 90*a*, a loading device 90*b*, a loading device 90*c*, a header pipe 540*a*, and a header pipe 540*b*. Hereinafter, if it is not particularly necessary to differentiate between the chilling unit 100*a*, the chilling unit 100*b*, and the chilling unit 100*c*, each of the chilling units 100*a* to 100*c* is referred to as the chilling unit 100. In addition, if it is not particularly necessary to differentiate between the loading device 90*a*, the loading device 90*b*, and the loading device 90*c*, each of the loading devices 90*a* to 90*c* is referred to as a loading device 90.

In the water circuit 530, in which water circulates as a heat medium, the loading device 90*a*, the loading device 90*b*, and the loading device 90*c* are connected to the respective pipes of the chilling unit 100*a*, the chilling unit 100*b*, and the chilling unit 100*c* via the header pipe 540*a* and the header pipe 54, the respective pipes being pipes through which a heat medium flows. The temperature control system using water circulation 500 includes a system control device 510 connected to the controllers 50 of the chilling units 100 and to the loading devices 90 so as to be able to communicate with each of the controllers 50 and each of the loading devices 90.

When loads on the loading devices 90 decrease, the system control device 510 gradually decreases the number of the chilling units 100 in operation in accordance with a total load, and finally, just one chilling unit 100 will operate. When the loads on the loading devices 90 further decrease and the total load is equal to or less than the lowest capacity of the compressor 1, the system control device 510 causes a chilling unit 100 in operation (e.g., chilling unit 100*a*) to perform control to avoid starts and stops described above.

It should be noted that the temperature control system using water circulation 500 may employ the plural chilling units 200 or the plural chilling units 300 in Embodiment 2 instead of the plural chilling units 100 in Embodiment 1. In this case, under low-load conditions, two chilling units 200 among all the chilling units 200 or two chilling units 300 among all the chilling units 300 are caused to operate.

Thus, even when the loads on the loading devices 90 have decreased, by using the chilling units 100 in Embodiment 1 or the chilling units 200 or the chilling units 300 in Embodiment 2, the temperature control system using water circulation 500 can suppress starts and stops of the compressor 1 caused by control of a thermostat and thus deal with a low load at an extremely flow rate of water. Even when little load is being applied to the loading devices 90, the temperature control system using water circulation 500 can adjust an amount of heat in the chilling unit so as to be proportional to the load. Thus, the temperature control system using water circulation 500 does not have to have a bypass pipe between the header pipe 540*a* and the header pipe 540*b* or a cushion tank, which is provided in existing temperature control systems using water circulation have.

As described above, in Embodiment 3, the temperature control system using water circulation 500 includes the plural chilling units 100, the plural chilling units 200, or the plural chilling units 300 provided for one heat medium circuit (water circuit 530) and the header pipe 540*a* and the header pipe 540*b* connected to the pipes of the plural chilling units.

Thus, as described above, in the chilling unit 100*a*, the chilling unit 100*b*, and the chilling unit 100*c*, even when a total load on the loading devices 90 is equal to or less than the lowest capacity of the compressor 1, by performing control to avoid starts and stops of the compressor 1, low pressure is stabilized and thus, the temperature of refrigerant is stabilized. Thus, the temperature control system using water circulation 500 can render the flow rate of a heat medium very low while suppressing occurrence of an abnormal stop. As a result, even under low-load conditions, the temperature control system using water circulation 500 can adjust an amount of heat in the chilling unit 100 so as to be proportional to a load. Accordingly, the temperature control system using water circulation 500 does not have to have, for example, a bypass or cushion tank on the load side of the water circuit 530, which enables the temperature control system using water circulation 500 to deal with a low flow rate of water and enables simplification of the configuration of the system.

It should be noted that embodiments of the present invention are not limited to the above embodiments, but various modifications can be made. For instance, the above descriptions relate to an air-cooled chilling unit in which even under low-load conditions, it is possible to suppress starts and stops of a compressor due to control of a thermostat. However, the techniques described above can, of course, be employed in a water-cooled chilling unit, a direct-expansion chiller, and a direct-expansion air-conditioner.

As an example of plural refrigerant circuits, two refrigerant circuits are employed in the above descriptions. However, by giving consideration to balance between cooling and heating, a unit having three refrigerant circuits, four refrigerant circuits, or five or more refrigerant circuits may be employed.

REFERENCE SIGNS LIST

1, 1*a*, 1*b* compressor 2, 2*a*, 2*b* first flow switching device 3 first air-side heat exchanger 3*a*, 3*b* air-side heat exchanger 4 second air-side heat exchanger 5, 5*a*, 5*b* expansion valve 6 subsidiary expansion valve 7, 7*a*, 7*b* heat-medium-side heat exchanger 8 second flow switching device 8*a*, 8*b* three-way valve 10, 201*a*, 210*b* refrigerant circuit 13, 14, 15, 19 refrigerant pipe 16 first bypass pipe 17 second bypass pipe 30, 230, 330 heat medium circuit 31 circulation pump 32, 34 temperature sensor 33, 35 pressure sensor 50, 250 controller 51 operation control unit 52 load determination unit 90(90*a*, 90*b*, 90*c*) loading device 100, 100*a*, 100*b*, 100*c*, 200 chilling unit 500 temperature control system using water circulation 510 system control device 530 water circuit 540*a*, 540*b* header pipe

The invention claimed is:

1. A chilling unit comprising:

two refrigerant circuits each including a compressor, a flow switching valve, an air-side heat exchanger, an expansion valve, and a heat-medium-side heat exchanger that are connected to each other by pipes, thereby enabling refrigerant to circulate in the respective refrigerant circuit;

a pipe that is connected to an air handler and through which a heat medium flows, the heat medium being used in heat exchange with the refrigerant performed in each of the heat-medium-side heat exchangers in the two refrigerant circuits;

a plurality of temperature sensors, each of which detects a temperature of the heat medium near each of an inlet and an outlet of the respective heat-medium-side heat exchanger in the two refrigerant circuits;

a plurality of pressure sensors, each of which detects a pressure difference between pressure of the heat medium near the inlet and pressure of the heat medium near the outlet, the inlet and the outlet being the inlet and the outlet of the respective heat-medium-side heat exchanger in the two refrigerant circuits;

a controller configured to control the compressors, the flow switching valves, and the expansion valves in the two refrigerant circuits, wherein each of the flow switching valves in the two refrigerant circuits switches between a circulation route for use in a heating mode in which the heat-medium-side heat exchanger serves as a condenser and a circulation route for use in a cooling mode in which the heat-medium-side heat exchanger serves as an evaporator, the controller controls the compressors in accordance with a target outlet temperature of the heat medium, the temperatures of the heat medium detected by each of the plurality of temperature sensors, and the pressure difference in the heat medium detected by each of the plurality of pressure sensors, and when a load on the air handler decreases to a low level and the load is equal to or less than the lowest capacity of the compressors, the controller causes the flow switching valve of one of the two refrigerant circuits to switch between the circulation routes while keeping the compressors operating at their lowest capacity.

2. The chilling unit of claim 1, wherein when the load on the air handler is zero, the controller controls an operation capacity of the compressor of at least one of the two refrigerant circuits so that a heating capacity of a refrigerant circuit operating in the heating mode among the two refrigerant circuits and a cooling capacity of a refrigerant circuit operating in the cooling mode among the two refrigerant circuits are identical.

3. The chilling unit of claim 1, further comprising an inverter circulation pump capable of changing a flow rate of the heat medium, wherein in the cooling mode to cool the heat medium, when the air handler is under low-load conditions, the controller controls an opening degree of the expansion valve in a refrigerant circuit operating in the cooling mode among the two refrigerant circuits so as to maintain a temperature of the refrigerant at which the heat-medium-side heat exchanger in the refrigerant circuit operating in the cooling mode does not freeze.

4. The chilling unit of claim 1, wherein in a heat medium circuit including the pipe, the heat-medium-side heat exchangers in the two refrigerant circuits are connected in series, and in the cooling mode to cool the heat medium, when the air handler is under low-load conditions, the controller causes the flow switching valve of a refrigerant circuit among the two refrigerant circuits to change a circulation route to the circulation route for use in the heating mode, the refrigerant circuit having the heat-medium-side heat exchanger on an upstream side in a direction in which the heat medium flows.

5. A temperature control system using water circulation comprising:

a plurality of the chilling units of claim 1 provided per heat medium circuit; and a header pipe connected to the pipes of the chilling units.

* * * * *